United States Patent [19]

Dalen et al.

[11] Patent Number: 5,045,168

[45] Date of Patent: Sep. 3, 1991

[54] POINT FEEDER FOR ALUMINIUM ELECTROLYSIS CELL

[75] Inventors: Kjell M. Dalen, Haugesund; Alfred Kvalavåg, Kvalavåg; Bernt Nagell, Haugesund, all of Norway

[73] Assignee: Norsk Hydro a.s., Oslo, Norway

[21] Appl. No.: 547,151

[22] Filed: Jul. 3, 1990

[30] Foreign Application Priority Data

Jul. 3, 1989 [NO] Norway ..... 892741

[51] Int. Cl.[5] ..... C25C 3/14; C25C 3/22

[52] U.S. Cl. ..... 204/245; 204/247

[58] Field of Search ..... 204/245, 243 R, 244, 204/246-247, 67

[56] References Cited

U.S. PATENT DOCUMENTS 3,192,140 6/1965 Zorzenoni ..... 204/247 X
3,977,950 8/1976 Tortil ..... 204/247 X
4,435,255 3/1984 Casdas ..... 204/245 X
4,437,964 3/1984 Gerphagnon et al. ..... 204/245

*Primary Examiner*—Donald R. Valentine
*Attorney, Agent, or Firm*—Wenderoth, Lind & Ponack

[57] ABSTRACT

In a feeder for feeding additives such as aluminium oxide or fluoride to aluminium electrolysis cells, the additives are fed to the electrolytic bath of the cell through a hole in the bath crust via a pipe stub. The hole is made by means of a crust breaker having a crow bar connected to a piston/cylinder device. The point feeder is made of a housing comprising an upper part, wholly or partly open to the surroundings, and a lower part closed the crust and other parts of the surroundings. The crow bar extends down through a guide in the form of a bushing, which is provided between the upper and lower part. Further, the pipe is attached to the lower part, or is provided under the lower part, for instance on the gas apron of the anode casing in a Soederberg cell.

16 Claims, 1 Drawing Sheet

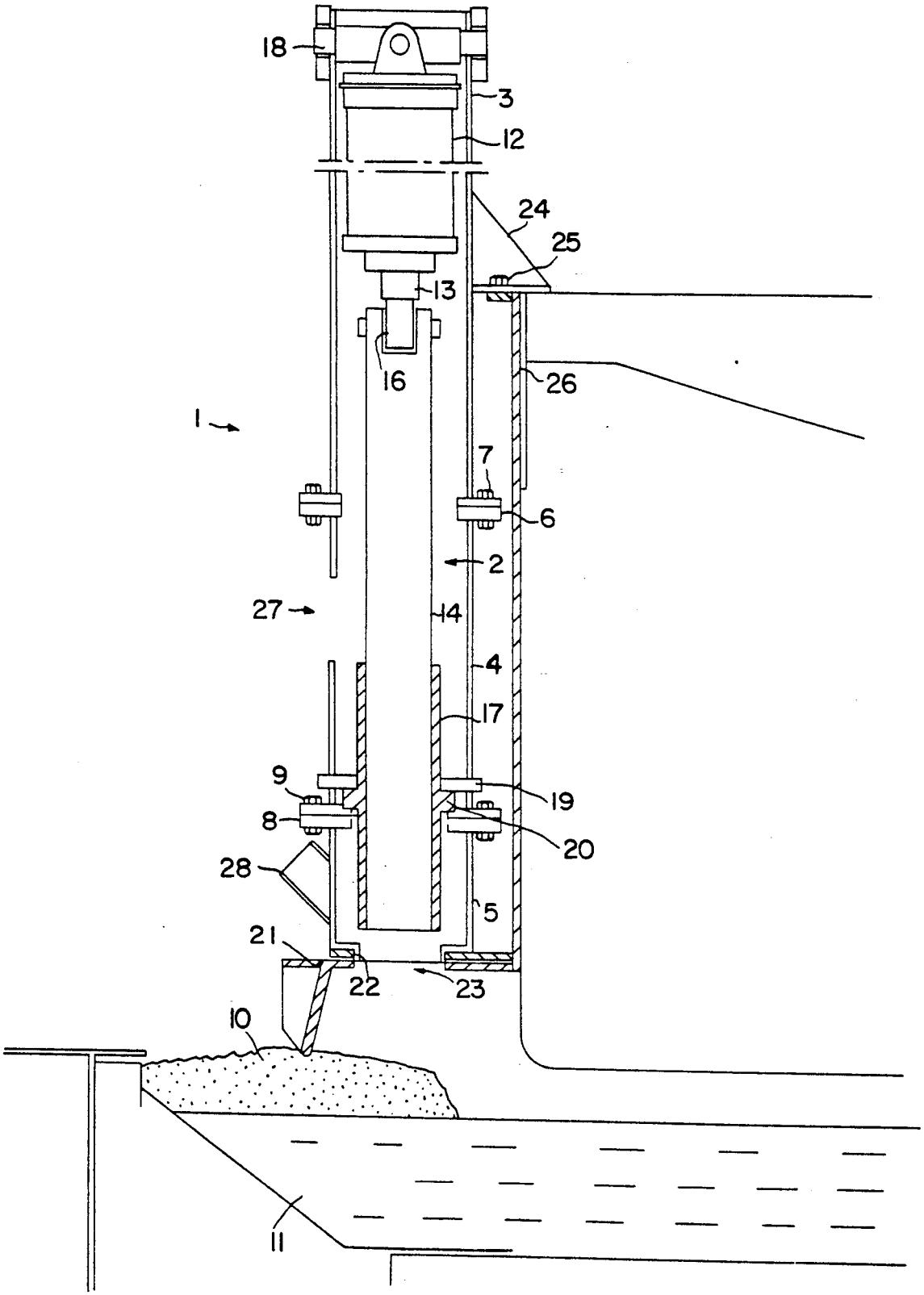
18
3
12
24
25
13
16
26
1
7
6
2
27
14
4
17
9
19
8
20
28
5
21
22
23
10
11

POINT FEEDER FOR ALUMINIUM ELECTROLYSIS CELL

BACKGROUND OF THE INVENTION

The present invention relates to a point feeder for feeding additives such as aluminium oxide or fluoride to aluminium electrolysis cells, particularly electrolysis cells of the Soederberg type, comprising an anode with a basically rectangular casing of steel or cast iron. The additives are fed to the electrolytic bath of the cell through a hole in the bath crust, which hole is made by means of a crust breaker, the crust beaker being a crow bar connected to a piston/cylinder device.

When producing aluminium according to the Hall-Heroult process one can distinguish between two different design principles. Thus, the electrolysis cells can be provided with self-baking anodes, the socalled Soederberg anodes, which are continuous, or with readily baked anodes of carbon, socalled prebaked anodes, which have to be exchanged during the electrolysis process as they are gradually consumed.

For both types of cells the anode is disposed above a cathode which principly has the same constructional design and comprises a rectangular steel shell which on the inside is provided with a thermal insulation of refractory bricks on the bottom and sides. On the high temperature side, on the inside of the thermal insulation, there is provided a carbon lining. This is designed as a shallow container containing an electrolytic bath and precipitated aluminium. In the carbon lining are disposed steel bars, so-called cathode bars, which provide the electric connection between the carbon cathode and outer busbars.

The electrolytic bath comprises aluminum oxide dissolved in melted cryolite with small amounts of additives, basically aluminum fluoride and calcium fluoride. During the electrolysis process, the aluminum oxide is used as it is decomposed to oxygen, which immediately reacts with the carbon of the anode, and aluminium, which due to the gravitational force sinks to the bottom of the cathode. The other additives are to some extent also used, and to maintain the chemical balance in the electrolytic bath, new additives have to be supplied to replace the ones being consumed.

It has for a long time been commonly known to feed additives to electrolytic cells by means of one or more point feeders being provided on the anode (through the carbon of the anode), on the side of the anode, or if it is a prebake cell, between the anode carbons. Such arrangements are, for instance, shown in Norwegian patent specification No. 844448, which is from 1954.

The point feeders have not found any broad application until the last decade, and their application has to a large extent been limited to the prebake cells. The reason for not using point feeders at an earlier stage seems to reside in the fact that there has not been any well developed control systems, and that the feeders per se have not been sturdy enough to resist the harmful environment in the electrolysis cells.

The advantages with the point feeders are several. The cells can be more optimally operated by keeping the chemical balance of the electrolytic bath at a uniform level. The manual work and the maintenance of the cells are further reduced and the gas and dust demission is, to a large extent, eliminated as the cells are completely closed.

As to the Soederberg cells, the feeding of these is still accomplished by means of the conventional method, by cutting the crust between the anode and the side of the cell by means of a crust breaker, whereafter the aluminium oxide is supplied to the melt from a vehicle or the like.

The point feeders being developed for the cells, with the prebaked anodes, cannot immediately be used for the Soederberg cells as the anode designed for the two cell types are different. As opposed to the cells with the prebaked anodes where the point feeders can be disposed between the anode carbons and where the whole anode construcation is built in under a cover, the Soederberg cells are completely open to their surroundings, and the only real possibility of localizing the point feeders would be to place them between the anode and the side crust of the cell. One of the main reasons for not having used point feeding on the Soederberg cells before are that there has not been developed point feeders which can be used in this area.

In Norwegian patent application No. 874538 is shown a method and a device for point feeding Soederberg cells where the point feeder is provided on an incision on the anode casing. If this solution is to be used on existing Soederberg cells, the anode casing has to be redesigned, which will involve large expenses. Besides, the point feeder is of the conventional type where a crust breaker comprising a piston/cylinder device is provided within a vertical pipe which is open downwardly towards the electrolytic bath, and where the additives are supplied through a pipe stub via the vertical pipe. The piston rod for the piston/cylinder device is directly exposed to gas, dust and heat from the electrolytic bath, and this, together with the side forces which the crow bar is exposed to, will soon lead to leakages in the packing between the piston rod and the cylinder due to wear.

SUMMARY OF THE INVENTION

With the present invention is provided a point feeder which is not encumbered with the above disadvantages, i.e. one which is sturdy and realiable, but is cheap to produce and simple to maintain.

The point feeder is particularly designed to be disposed on the gas apron of the anode casing of Soederberg cells for the supply of additives through the gas apron, but it can also be applied outside the gas apron, i.e. in the space between the gas apron and the side of the cathode.

The point feeder is so designed that the piston rod for the piston/cylinder device will not be exposed to side forces. Further, the piston/cylinder device, including the piston rod, is prevented from coming into contact with gas, dust and heat from the electrolytic bath. An example of the point feeder according to the invention will now be further described with reference to the attached drawing.

BRIEF DESCRIPTION OF THE DRAWINGS

The drawing shows a vertical cross section of a point feeder mounted on a Soederberg cell (only a part of the cell is shown).

DETAILED DESCRIPTION OF THE PREFERRED EMBODIMENT

A point feeder has a frame or housing 1, a crust breaker 2 provided inside of the housing, and a pipe stub 28 connected to the housing for the supply of additives to the cell bath 11.

The housing 1 comprises an upper part 3, 4 wholly or partly open the surroundings, and a lower part 5, downwardly open, but closed to the upper part and the surroundings. To make the mounting and demounting of the point feeder more easy, the upper part 3, 4 of the housing is further divided into two parts 3 and 4. The two parts are connected to one another by means of a flange connection 6 with screws 7.

A similar flange/screw connection 8 and 9 is used between the upper part 3, 4 and the lower part 5.

As mentioned above, the crust breaker 2 is provided inside the housing parts 3, 4, 5. It includes a piston/cylinder device 12 with a chisel or crowbar 14. The crowbar 14 is connected with a piston rod 13 via a joint 16 and extends down through a bushing 17, whereas the piston/cylinder device is connected with the housing by means of a universal joint 18. The purpose of designing the crust breaker 2 as indicated above is to avoid having the piston rod 13 exposed to side forces when the crow bar 14 is forced down through the crust 10. Wear of the piston rod 13 and the packing of the cylinder device 12 is thereby to a large extent, eliminated.

The bushing 17 guides the crow bar 14 and is designed to scrape off any electrolytic bath sticking to the crow bar when it is retracted to its initial position. The clearance between the crow bar and the bushing is so narrow that gas and dust emission to the upper part of the housing (environments) is prevented.

The bushing is provided with a flange 20 and rests via this flange on an inwardly protruding flange connection 8 between the upper and lower part of the housing 1. A locking pin 19 extending through the wall of the housing on the upper side of the flange 20 keeps the bushing 17 in a locked position.

At the same time as the flange 20 connects the bushing 17 with the housing, it also serves as s closure for the opening between the upper and lower parts of the housing.

As mentioned initially, the point feeder is particularly designed to feed additives through the gas apron on the anode casing of the Soederberg type. The point feeder is illustrated as provided on the upper side of the gas apron 21. It rests on the gas apron and is held in position by a guide 22 on the lower part 5, which guide 22 extends down through a hole 23 in the apron. The point feeder is attached to a substantially rectangular steel or cast iron anode casing 26 by means of brackets 24 and screw connections 25. Thus the point feeder is not connected to the gas apron 21 by its lower part 5, and in connection with repair and maintenance, the point feeder can be simply and easily taken down and replaced by a new point feeder, simply by unscrewing the screws 25 and disconnecting the housing for the piston/cylinder device 12 and supply pipe (not shown) for the pipe stub 28.

The herein described simple way of attaching the point feeder to the anode casing makes it possible to provide existing Soederberg cells with point feeders by only making minor changes.

The pipe stub 28 for the supply of additives to the cell bath is connected to the lower part of the housing 5. The additives are supplied to the pipe stub via a pipe (not shown) from a dosage device preferably disposed close to the point feeder on the anode. Alternatively, the dosage device may be of the type described in applicant's own Norwegian patent application No. 874220.

As previously mentioned, the lower part 5 of the point feeder housing forms a closed space relative to the upper part 3, 4. The piston/cylinder device is thereby prevented from being exposed to dust, heat and gases present at the lower part 5 and under the gas apron 21. Besides the upper part 3, 4 is provided with holes 27, or is in a way wholly or partly open towards the surroundings, so that air is circulated through the upper part to cool the piston/cylinder device. With the herein described design of the point feeder is achieved a prolonged life time for the piston/cylinder device.

The point feeder works in the following way: When additives (for the most part aluminium oxide), are supplied to the melt, the crow bar 14 is moved in downwards direction by means of the piston/cylinder device 12, making a hole in the crust 10. The crow bar is thereafter returned to its initial position and any melt sticking to the crow bar is scraped off at the lower edge of the housing 17. The additives can now be supplied to the melt through the hole in the crust via the pipe stub 28.

It should be mentioned that since there may occur a short circuit when the crow bar extends into the melt, the upper part of the housing 3, 4 with the piston/cylinder device, the crow bar and the bushing 17 is electrically insulated from the anode (the anode casing and the gas apron).

With regard to the housing of the point feeder, this may be made of steel pipes with any kind of cross section, like square cross section, round cross section, etc. Alternatively, the upper part 3, 4 may be made of a completely open frame construction of steel bars.

It should be mentioned that, even if it has previously been stated that the point feeder preferably can be disposed on the anode casing for the supply of additives through the gas apron, the point feeder may also be used to supply additives through the crust on the outside of the gas apron. In such case it would be preferable to let the lower part 5 of the housing strech all the way down to the crust. It also should be emphasized that the point feeder not only can be used for point feeding of Soederberg cells, but may also be used in prebaked cells.

I claim:

1. A point feeder for feeding additives to electrolysis cells, comprising:

a housing, said housing having an upper portion and a lower portion connected to each other;

a piston/cylinder device mounted in said upper portion of said housing, said upper portion of said housing being at least partly open such that said piston/cylinder device is at least partly exposed to the environment outside of said upper portion of said housing;

a bar for breaking a hole in the crust of an electrolysis cell movably mounted in said housing;

said bar being connected to said piston/cylinder device for movement thereby;

pipe means for feeding additives to the hole in the crust made by the bar; and guide means for guiding said bar as it is moved by said piston/cylinder device, said guide means being mounted at the connection between said upper portion and said lower portion of said housing, and said guide means comprising a bushing.

2. The point feeder of claim 1, wherein said lower portion of said housing opens downwardly to enable said bar to extend therethrough, and wherein said guide means, with said bar therein, closes off said upper portion from said lower portion, whereby gas, dust and heat from an electrolytic bath are prevented from reaching said piston/cylinder device.

3. The point feeder of claim 2, wherein said lower portion of said housing has said pipe means connected thereto for feeding additives to an electrolytic bath, said pipe means comprising a pipe.

4. The point feeder of claim 2, wherein said piston/-cylinder device is movably mounted to said upper portion of said housing by a first joint, said piston/cylinder device has a piston rod, and said bar is movably connected to said piston rod of said piston/cylinder device by a second joint.

5. The point feeder of claim 4, wherein each said joint is a universal joint.

6. The point feeder of claim 1, wherein said upper portion of said housing comprises steel pipe.

7. The point feeder of claim 1, wherein said upper portion of said housing is made of a steel frame comprising steel bars and said lower portion of said housing is made of a steel pipe.

8. A point feeder for feeding additives to an aluminum electrolysis cell having a crust on an electrolytic bath, said point feeder comprising:

a housing comprising an upper portion and a lower portion;

a piston/cylinder device mounted in said upper portion of said housing, said upper portion of said housing being at least partly open such that said piston/cylinder device is at least partly exposed to the environment outside of said upper portion of said housing;

a bar for breaking the crust of the electrolysis cell and forming a hole therethrough so that additives can be supplied to the electrolytic bath, said bar being connected to said piston/cylinder device for movement thereby;

a guide means for guiding said bar as it is moved by said piston cylinder device, said guide means being mounted between said upper portion and said lower portion of said housing, and said guide means comprising a bushing; and pipe means for feeding additives to the hole in the crust made by said bar;

wherein said lower portion of said housing opens downwardly toward the crust but is otherwise closed to its environment, including said upper portion of said housing.

9. The point feeder of claim 8, wherein the electrolysis cell is a Soederberg type electrolysis cell having an anode with a substantially rectangular metal casing and a gas apron about said electrolytic bath, said pipe means being disposed on said gas apron.

10. The point feeder of claim 8, wherein said pipe means is disposed on said lower portion of said housing.

11. The point feeder of claim 8, wherein the electrolysis cell has an anode with a substantially rectangular metal casing, and brackets are connected to said upper portion of said housing mounting said housing to said substantially rectangular metal casing.

12. The point feeder of claim 8, wherein said guide means closes off said lower portion of said housing from said upper portion of said housing, whereby gas, dust and heat from the electrolytic bath are prevented from reaching said piston/cylinder device.

13. The point feeder of claim 8, wherein said piston/-cylinder device is movably mounted to said upper portion of said housing by a first joint, said piston/cylinder device has a piston rod, and said bar is movably connected to said piston rod of said piston/cylinder device by a second joint.

14. The point feeder of claim 13, wherein each said joint is a universal joint.

15. The point feeder of claim 8, wherein said upper portion of said housing comprises steel pipe.

16. The point feeder of claim 8, wherein said upper portion of said housing is made of a steel frame comprising steel bars and said lower portion of said housing is made of a steel pipe.

* * * * *